US011777226B2

(12) United States Patent
Nakajima et al.

(10) Patent No.: US 11,777,226 B2
(45) Date of Patent: Oct. 3, 2023

(54) REFLECTOR ANTENNA DEVICE

(71) Applicant: Mitsubishi Electric Corporation, Tokyo (JP)

(72) Inventors: Hiromasa Nakajima, Tokyo (JP); Shinichi Yamamoto, Tokyo (JP); Michio Takikawa, Tokyo (JP); Shuji Nuimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/700,915

(22) Filed: Mar. 22, 2022

(65) Prior Publication Data

US 2022/0216618 A1 Jul. 7, 2022

Related U.S. Application Data

(63) Continuation of application No. PCT/JP2019/046266, filed on Nov. 27, 2019.

(51) Int. Cl.
*H01Q 19/13* (2006.01)
*H01Q 5/30* (2015.01)
(Continued)

(52) U.S. Cl.
CPC ..... *H01Q 19/13* (2013.01); *H01Q 5/30* (2015.01); *H01Q 15/16* (2013.01); *H01Q 19/19* (2013.01)

(58) Field of Classification Search
CPC ..... H01Q 19/13; H01Q 5/30; H01Q 15/16; H01Q 19/19; H01Q 15/0013; H01Q 19/026; H01Q 19/132
See application file for complete search history.

(56) References Cited

U.S. PATENT DOCUMENTS 6,831,613 B1 * 12/2004 Gothard ..... H01Q 19/19 343/781 CA
6,911,953 B2 * 6/2005 Gothard ..... H01Q 5/47 343/781 CA
(Continued)

FOREIGN PATENT DOCUMENTS

CA 1275494 C 10/1990
JP 55-92002 A 7/1980
(Continued)

OTHER PUBLICATIONS

Extended European Search Report dated Sep. 23, 2022 in corresponding European Patent Application No. 19 954 024.6.
(Continued)

*Primary Examiner* — Vibol Tan
(74) *Attorney, Agent, or Firm* — BIRCH, STEWART, KOLASCH & BIRCH, LLP

(57) ABSTRACT

A reflector antenna device includes: a primary radiator to radiate a first radio wave in a first frequency band and a second radio wave in a second frequency band lower in frequency than the first frequency band; and a reflector having a reflection face reflecting the first radio wave and the second radio wave radiated by the primary radiator, in which the reflection face of the reflector has a first region including a center point of the reflection face and a second region that is an outer peripheral region of the first region and is provided with a plurality of recesses, and each of the plurality of recesses is configured to allow entrance of the first radio wave, restrict entrance of the second radio wave, and reflect the first radio wave having entered the recess on a bottom face of the recess.

20 Claims, 8 Drawing Sheets

(51) Int. Cl.
*H01Q 15/16* (2006.01)
*H01Q 19/19* (2006.01)

(56) References Cited

U.S. PATENT DOCUMENTS

| | | | | |
|---|---|---|---|---|
| 6,937,201 | B2 * | 8/2005 | Gothard | H01Q 5/47 343/781 CA |
| 6,982,679 | B2 * | 1/2006 | Kralovec | H01Q 13/0208 343/781 CA |
| 10,797,401 | B2 | 10/2020 | Takikawa et al. | |

FOREIGN PATENT DOCUMENTS

| | | | | | |
|---|---|---|---|---|---|
| JP | 59-44108 | A | | 3/1984 | |
| JP | 62-173804 | A | | 7/1987 | |
| JP | 5-251925 | A | | 9/1993 | |
| JP | 6218990 | B1 | | 10/2017 | |
| JP | 2018137743 | A | * | 8/2018 | |
| WO | WO-0013261 | A1 | * | 3/2000 | H01Q 15/14 |

OTHER PUBLICATIONS

International Search Report (PCT/ISA/210) issued in PCT/JP2019/046266, dated Feb. 10, 2020.

* cited by examiner

REFLECTOR ANTENNA DEVICE

CROSS REFERENCE TO RELATED APPLICATIONS

This application is a Continuation of PCT International Application No. PCT/JP2019/046266, filed on Nov. 27, 2019, which is hereby expressly incorporated by reference into the present application.

TECHNICAL FIELD

The present invention relates to a reflector antenna device including a primary radiator and a reflector.

BACKGROUND ART

There is a reflector antenna device that includes a primary radiator that radiates radio waves in a plurality of frequency bands and a reflector that reflects the radio waves in the plurality of frequency bands radiated by the primary radiator to output the radio waves in the plurality of frequency bands. In a case where the primary radiator radiates radio waves in a plurality of frequency bands, the beam widths of main lobes of the radio waves in the plurality of frequency bands radiated by the primary radiator are greatly different.

In the above-described reflector antenna device, a part of radio waves in a high frequency band that is a higher frequency band among radio waves in a plurality of frequency bands radiated by the primary radiator may be incident on the reflector as side lobes. Since the side lobe closest to the main lobe has a phase inverted with respect to the main lobe, in a case where the side lobe incident on the reflector is reflected by the reflector, a gain of a secondary radiation pattern, which is a radiation pattern of the radio wave reflected by the reflector, decreases.

Patent Literature 1 discloses an antenna device in which in a dual reflector antenna including a sub-reflector that shares at least two frequency bands, a reflecting mirror face of the sub-reflector is concentrically divided into two regions of a first center region and a second outer peripheral region, the first center region is formed of a metal reflection face, and the second outer peripheral region is formed of a frequency-selective reflection face having transmission characteristic in a high frequency band and reflection characteristic in a low frequency band. The antenna device (hereinafter, referred to as a "conventional reflector antenna device") disclosed in Patent Literature 1 has the above-described configuration to suppress a decrease in gain of the secondary radiation pattern.

CITATION LIST

Patent Literatures

Patent Literature: Japanese Patent Laid-open Publication No. 55-092002

SUMMARY OF INVENTION

Technical Problem

In the conventional reflector antenna device, the side lobe of the radio wave in the high frequency band radiated by the primary radiator passes through the second outer peripheral region. Therefore, the conventional reflector antenna device can suppress a decrease in gain of a secondary radiation pattern of the radio wave in the high frequency band radiated by the primary radiator, but spillover of a side lobe occurs, and a secondary radiation pattern with high gain cannot be obtained in the radio wave in the high frequency band.

The present invention has been made to solve the above-described problems, and an object of the present invention is to provide a reflector antenna device capable of suppressing spillover of a side lobe of a radio wave in a high frequency band while suppressing a decrease in gain of a secondary radiation pattern of the radio wave in the high frequency band.

Solution to Problem

A reflector antenna device according to the present invention includes: a primary radiator to radiate a first radio wave that is a radio wave in a first frequency band and radiate a second radio wave that is a radio wave in a second frequency band lower in frequency than the first frequency band; and a reflector having a reflection face that receives the first radio wave and the second radio wave radiated by the primary radiator and reflects the first radio wave and the second radio wave, in which the reflection face included in the reflector has a first region including a center point of the reflection face and a second region that is an outer peripheral region of the first region and is a region provided with a plurality of recesses, and each of the plurality of recesses provided in the second region of the reflection face included in the reflector is configured to allow the first radio wave to enter the recess, restrict the second radio wave from entering the recess, and reflect the first radio wave that has entered the recess on a bottom face of the recess.

Advantageous Effects of Invention

According to the present invention, it is possible to suppress spillover of a side lobe of a radio wave in a high frequency band while suppressing a decrease in gain of a secondary radiation pattern of the radio wave in a high frequency band.

DESCRIPTION OF EMBODIMENTS

In order to explain the present invention in more detail, a mode for carrying out the present invention will be described below with reference to the accompanying drawings.

First Embodiment

A configuration of a main part of a reflector antenna device 100 according to a first embodiment will be described with reference to FIG. 1.

FIG. 1 is a configuration diagram illustrating an example of a configuration of a main part of the reflector antenna device 100 according to the first embodiment.

The reflector antenna device 100 includes a primary radiator 110, a first reflector 120, and a second reflector 130.

The reflector antenna device 100 is, for example, a reflector antenna including a plurality of reflectors such as a Gregorian antenna or a Cassegrain antenna. In the first embodiment, the reflector antenna device 100 will be described as a Gregorian antenna as illustrated in FIG. 1 as an example.

Figure 1A:
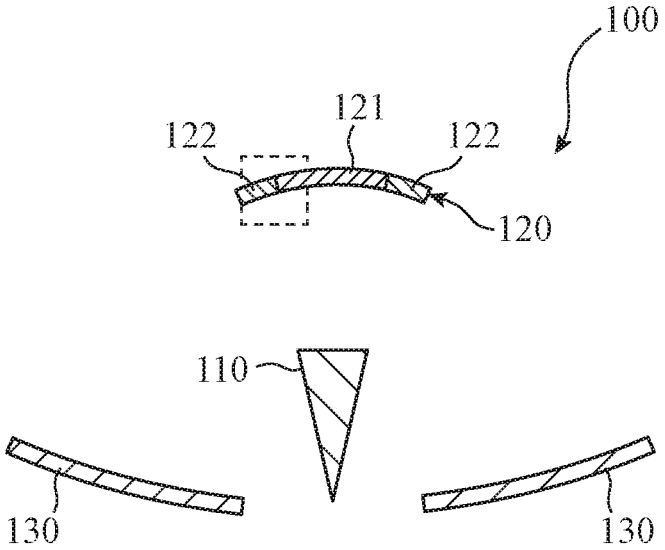
FIG. 1A is a configuration diagram illustrating an example of a configuration of a main part of a reflector antenna device according to a first embodiment.

FIG. 1A is a configuration diagram illustrating an example of a configuration of a main part of the reflector antenna device 100 according to the first embodiment, and is a cross-sectional view of the reflector antenna device 100 on a plane including a radiation axis of a primary radiator 110 included in the reflector antenna device 100.

Figure 1C:
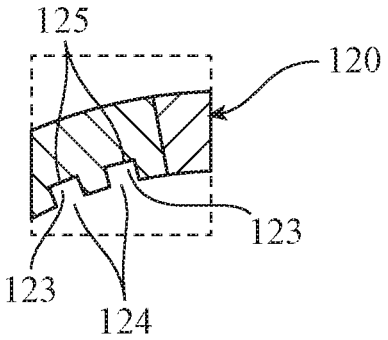
FIG. 1C is a configuration diagram illustrating an example of the configuration of the main part of the first reflector included in the reflector antenna device according to the first embodiment.
Figure 1B:
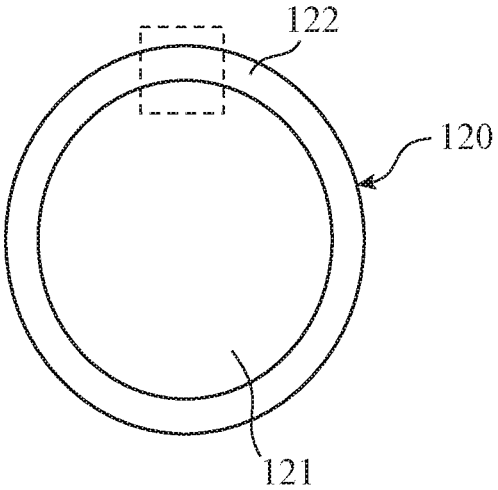
FIG. 1B is a configuration diagram illustrating an example of the configuration of the main part of the first reflector 120 included in the reflector antenna device according to the first embodiment.

FIG. 1B is a configuration diagram illustrating an example of a configuration of a main part of the first reflector 120 included in the reflector antenna device 100 according to the first embodiment, and is a configuration diagram of the first reflector 120 viewed from the primary radiator 110 included in the reflector antenna device 100 according to the first embodiment.

FIG. 1C is a configuration diagram illustrating an example of a configuration of the main part of the first reflector 120 included in the reflector antenna device 100 according to the first embodiment, and is an enlarged view of the first reflector 120 in a region surrounded by a rectangle indicated by a broken line in FIG. 1A.

Figure 1D:
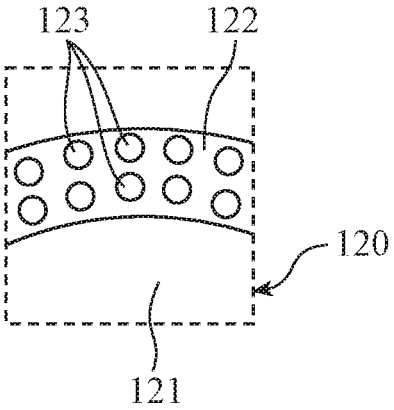
FIG. 1D is a configuration diagram illustrating an example of the configuration of the main part of the first reflector included in the reflector antenna device according to the first embodiment.

FIG. 1D is a configuration diagram illustrating an example of a configuration of the main part of the first reflector 120 included in the reflector antenna device 100 according to the first embodiment, and is an enlarged view of the first reflector 120 in a region surrounded by a rectangle indicated by a broken line in FIG. 1B.

The primary radiator 110 is a radiator that radiates a first radio wave that is a radio wave in a first frequency band and radiates a second radio wave that is a radio wave in a second frequency band lower in frequency than the first frequency band.

In the first embodiment, the primary radiator 110 is described as one radiator that radiates the first radio wave and the second radio wave, but the primary radiator 110 may be a radiator in which two radiators are combined, such as a radiator in which a radiator that radiates the first radio wave and another radiator that radiates the second radio wave are combined.

The first reflector 120 is a reflector having a reflection face that receives the first radio wave and the second radio wave radiated from the primary radiator 110 and reflects the first radio wave and the second radio wave.

In the reflector antenna device 100 according to the first embodiment, the first reflector 120 is a sub-mirror.

The reflection face of the first reflector 120 as a reflector is, for example, a curved face such as a quadratic face or a parabolic face.

The reflection face of the first reflector 120 as a reflector includes a first region 121 including a center point of the reflection face, and a second region 122 that is an outer peripheral region of the first region 121 and is a region provided with a plurality of recesses 123.

Note that the plurality of recesses 123 (hereinafter, simply referred to as a "plurality of recesses 123") provided on the reflection face in the second region 122 may be periodically arranged or may be arranged at any positions in the second region 122.

The reflection face in the first region 121 (hereinafter, simply referred to as a "first region 121") included in the first reflector 120 is made of, for example, a conductor such as metal, and the reflection face in the first region 121 is processed into a smooth shape without unevenness.

The reflection face in the first region 121 receives a main lobe of the first radio wave radiated by the primary radiator 110 and a main lobe of the second radio wave radiated by the primary radiator 110. The reflection face in the first region 121 reflects the main lobe of the first radio wave and the main lobe of the second radio wave toward the second reflector 130.

The reflection face in the second region 122 (hereinafter, simply referred to as a "second region 122") included in the first reflector 120 is made of, for example, a conductor such as metal, and the plurality of recesses 123 are formed by processing such as casting, cutting, or tapping.

The reflection face in the second region 122 receives a side lobe of the first radio wave radiated by the primary radiator 110 and the main lobe of the second radio wave radiated by the primary radiator 110.

Each of the plurality of recesses 123 allows the first radio wave to enter the recess 123, restricts the second radio wave from entering the recess 123, and reflects the first radio wave having entered the recess 123 on a bottom face 125 of the recess 123.

Specifically, each of the plurality of recesses 123 allows the side lobe of the first radio wave radiated by the primary radiator 110 to enter the recess 123, and reflects the side lobe of the first radio wave having entered the recess 123 on the bottom face 125 of the recess 123. More specifically, each of the plurality of recesses 123 reflects the side lobe of the first radio wave having entered the recess 123 toward the second reflector 130. Further, each of the plurality of recesses 123 restricts the main lobe of the second radio wave radiated by the primary radiator 110 from entering the recess 123, and reflects the main lobe of the second radio wave not entering the recess 123 toward the second reflector 130.

With such a configuration, the reflector antenna device 100 can suppress the spillover of the side lobe of the radio wave in the high frequency band while suppressing the decrease in the gain of the secondary radiation pattern of the radio wave in the high frequency band.

Each of the plurality of recesses 123 has, for example, a circular shape in a cross section in a plane parallel to the reflection face. That is, each of the plurality of recesses 123 is a cylindrical recess provided on the reflection face in the second region 122.

The shape of the cross section in the plane parallel to the reflection face of each of the plurality of recesses 123 is not limited to a circular shape.

Figure 2:
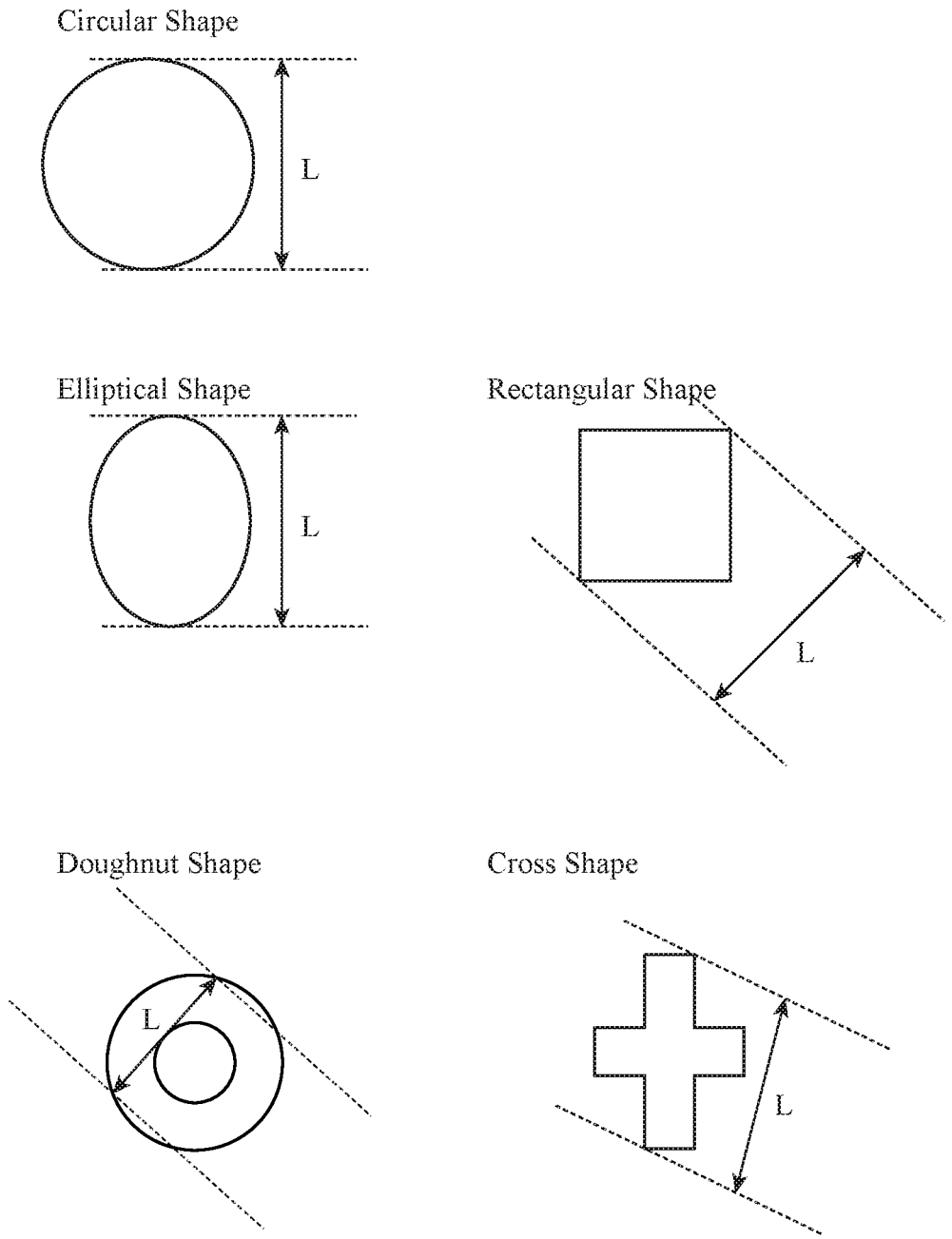
FIG. 2 is a configuration diagram illustrating an example of a shape of each of a plurality of recesses according to the first embodiment.

FIG. 2 is a configuration diagram illustrating an example of a shape of each of the plurality of recesses 123 according to the first embodiment, and is a configuration diagram illustrating an example of the shape of the cross section in a plane parallel to the reflection face of each of the plurality of recesses 123.

As illustrated in FIG. 2, the shape of the cross section in the plane parallel to the reflection face of each of the plurality of recesses 123 may be an elliptical shape, a rectangular shape, a doughnut shape, a cross shape, or the like. The plurality of recesses 123 may be a combination of recesses having different shapes of the cross section in a plane parallel to the reflection face.

The second reflector 130 is a reflector having a reflection face that receives the first radio wave and the second radio wave reflected by the first reflector 120 and reflects the first radio wave and the second radio wave.

In the reflector antenna device 100 according to the first embodiment, the second reflector 130 is a main mirror.

For example, the second reflector 130 reflects the first radio wave and the second radio wave reflected by the first reflector 120 in a predetermined direction in which the reflector antenna device 100 outputs the first radio wave and the second radio wave.

The reflector antenna device 100 outputs the first radio wave and the second radio wave reflected by the second reflector 130 in a predetermined direction.

The maximum value "L" of the length in the plane parallel to the reflection face of each of the plurality of recesses 123 falls, for example, within a range determined by the following formula (1).

$$\frac{C_x}{\pi F_H} < L < \frac{C_x}{\pi F_L} \tag{1}$$

Here, "C" is the speed of light, "$\chi$" is the positive minimum root in the first derivative of the Bessel function of the first type, "$\pi$" is the circular constant, "$F_H$" is the first frequency band, and "$F_L$" is the second frequency band.

Note that the value of $\chi$, which is the positive minimum root in the first derivative of the Bessel function of the first type, is 1.841.

Figure 3:
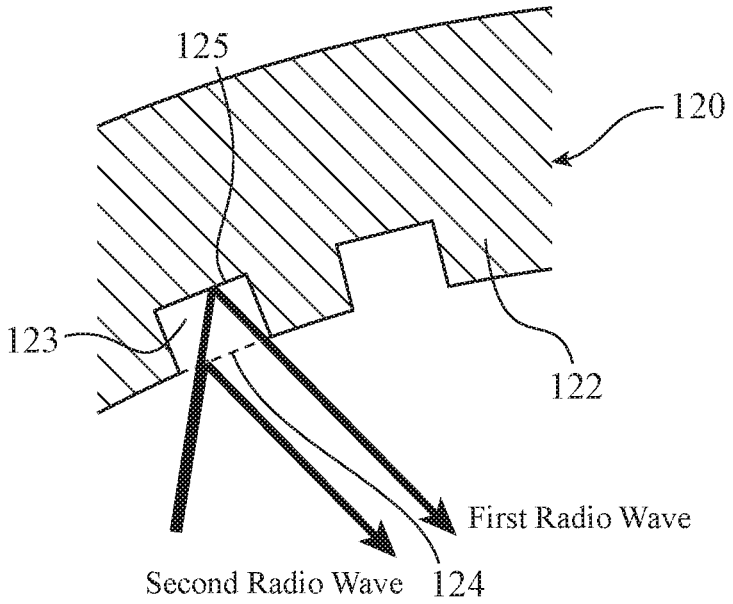
FIG. 3 is a diagram illustrating an example of behavior of a first radio wave and a second radio wave incident on a certain recess provided on a reflection face in a second region according to the first embodiment.

With reference to FIG. 3, behaviors of the first radio wave and the second radio wave incident on a certain recess 123 provided on the reflection face in the second region 122 according to the first embodiment will be described.

FIG. 3 is a diagram illustrating an example of behaviors of the first radio wave and the second radio wave incident on a certain recess 123 provided on the reflection face in the second region 122 according to the first embodiment.

For example, in a case where the maximum value of the length in the plane parallel to the reflection face of each of the plurality of recesses 123 satisfies the condition shown in the formula (1), the second radio wave in the second frequency band having a frequency lower than that of the first frequency band which is a high frequency band is reflected at an opening 124 of each recess 123 since the maximum value of the length is shorter than the wavelength of the second radio wave.

On the other hand, in this case, since the maximum value of the length is longer than the wavelength of the first radio wave, the first radio wave in the first frequency band that is a high frequency band enters each recess 123 and is reflected on the bottom face 125 of each recess 123 facing the opening 124 of each recess 123.

For example, each of the plurality of recesses 123 is processed so that the depth is an odd multiple of ¼ wavelength of the first radio wave.

The depth of each of the plurality of recesses 123 does not need to be strictly ¼ wavelength of the first radio wave, and the ¼ wavelength of the first radio wave herein includes approximately ¼ wavelength.

Further, as for the depths of the plurality of recesses 123, all the depths of the plurality of recesses 123 do not need to be ¼ wavelength of the first radio wave, and may be, for example, any depth depending on the distances from the center point of the reflection face or the like.

In a case where the depth of each of the plurality of recesses 123 is an odd multiple of ¼ wavelength of the first radio wave, the phase of the first radio wave reflected on the bottom face 125 of the recess 123 is inverted with respect to the phase of the first radio wave incident on the recess 123 at the opening 124 of the recess 123.

Note that the depth of the recess 123 is a distance from the opening 124 of the recess 123 to the bottom face 125 of the recess 123.

The side lobe closest to the main lobe has a phase inverted with respect to the main lobe.

As described above, the reflection face in the first region 121 receives the main lobe of the first radio wave radiated by the primary radiator 110 and the main lobe of the second radio wave radiated by the primary radiator 110. As described above, the reflection face in the second region 122 receives the side lobe of the first radio wave radiated by the primary radiator 110 and the main lobe of the second radio wave radiated by the primary radiator 110.

Therefore, in a case where the depth of each of the plurality of recesses 123 is an odd multiple of the ¼ wavelength of the first radio wave, the side lobe of the first radio wave reflected on the bottom face 125 of the recess 123 has the same phase as the main lobe of the first radio wave reflected by the reflection face in the first region 121 at the opening 124 of the recess 123. Further, the main lobe of the second radio wave reflected at the opening 124 of the recess 123 has the same phase as the main lobe of the second radio wave reflected by the reflection face in the first region 121.

Note that the same phase referred to herein does not need to be strictly the same phase, and includes substantially the same phase.

Although the case where the depth of each of the plurality of recesses 123 is an odd multiple of the ¼ wavelength of the first radio wave has been described, the depth may not be an odd multiple of the ¼ wavelength of the first radio wave. In each of the plurality of recesses 123, the phase of the first radio wave having entered the recess 123 and reflected on the bottom face 125 of the recess 123 may be the same phase as the phase of the first radio wave reflected by the first region 121 of the reflection face of the reflector at the opening 124 of the recess 123. For example, in a case where the plurality of recesses 123 are filled with a dielectric, the depth may be set so that the side lobe of the first radio wave reflected on the bottom face 125 of the recess 123 and the main lobe of the first radio wave reflected by the reflection face in the first region 121 have the same phase at the opening 124 of the recess 123 in consideration of the relative permittivity of the dielectric.

First Example

An example of the reflector antenna device 100 according to the first embodiment will be described with reference to FIGS. 4 to 6.

Figure 4:
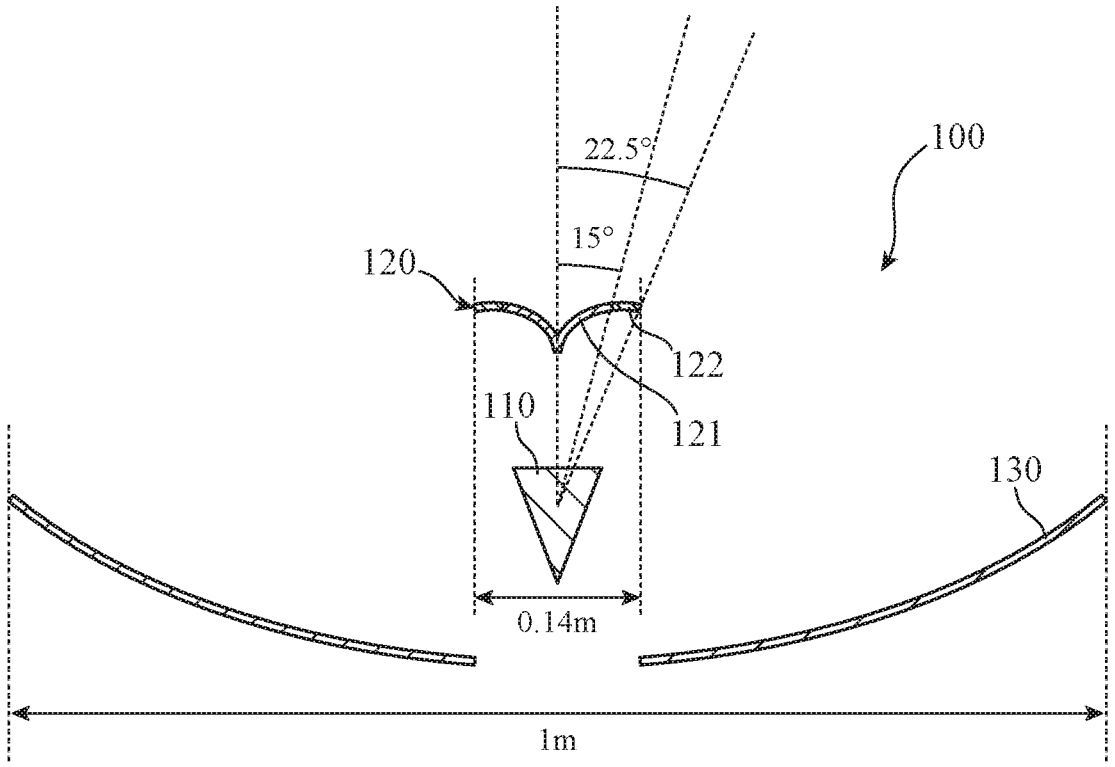
FIG. 4 is a configuration diagram illustrating a configuration of the reflector antenna device according to the first embodiment, a reflector antenna device according to a first example.

FIG. 4 is a configuration diagram illustrating a configuration of the reflector antenna device 100 according to the first embodiment and the reflector antenna device 100 according to a first example.

The reflector antenna device 100 illustrated in FIG. 4 includes a primary radiator 110, a first reflector 120, and a second reflector 130.

As illustrated in FIG. 4, the reflector antenna device 100 according to the first example is a ring-focus type Gregorian antenna.

The primary radiator 110 is an ideal horn antenna that excites the radio wave in the HE11 mode. The primary radiator 110 radiates a first radio wave in a 30 GHz (gigahertz) band that is a first frequency band and a second radio wave in a 20 GHz band that is a second frequency band lower in frequency than the first frequency band.

Figure 5:
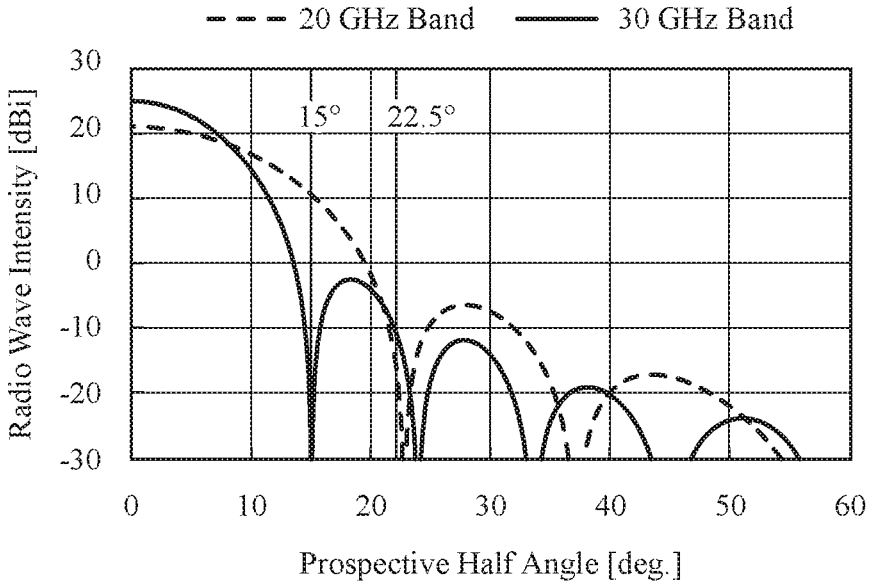
FIG. 5 is a diagram illustrating radiation patterns of a first radio wave and a second radio wave radiated by a primary radiator included in the reflector antenna device according to the first example.

FIG. 5 is a diagram illustrating radiation patterns of the first radio wave and the second radio wave radiated by the primary radiator 110 included in the reflector antenna device 100 according to the first example.

In FIG. 5, the horizontal axis represents an angle (hereinafter, referred to as "prospective half angle") formed between a direction in which the primary radiator 110 radiates the first radio wave and the second radio wave and the radiation axis with a predetermined point on the radiation axis at which the primary radiator 110 radiates the first radio wave and the second radio wave as an origin. In FIG. 5, the vertical axis represents the intensity of each of the first radio wave and the second radio wave radiated by the primary radiator 110.

As illustrated in FIG. 5, the primary radiator 110 radiates the main lobe of the first radio wave in the prospective half angle of less than 15 degrees, and radiates the side lobe of the first radio wave in the prospective half angle of more than or equal to 15 degrees and less than or equal to 22.5 degrees. In addition, the primary radiator 110 radiates the main lobe of the second radio wave in the prospective half angle of less than or equal to 22.5 degrees.

The first reflector 120 is a ring focus mirror having a mirror diameter of 0.14 m (meters). The reflection face of the first reflector 120 reflects, among the first radio wave and the second radio wave radiated by the primary radiator 110, the first radio wave and the second radio wave having the prospective half angle of more than or equal to 0 degrees and less than or equal to 22.5 degrees toward the second reflector 130. Specifically, the reflection face in the first region 121 reflects, among the first radio wave and the second radio wave radiated by the primary radiator 110, the first radio wave and the second radio wave having the prospective half angle of more than or equal to 0 degrees and less than 15 degrees toward the second reflector 130. That is, the reflection face in the first region 121 reflects the main lobe of the first radio wave and the main lobe of the second radio wave toward the second reflector 130. Further, the reflection face in the first region 121 reflects, among the first radio wave and the second radio wave radiated by the primary radiator 110, the first radio wave and the second radio wave having the prospective half angle of more than or equal to 15 degrees and less than 22.5 degrees toward the second reflector 130. That is, the reflection face in the first region 121 reflects the side lobe of the first radio wave and the main lobe of the second radio wave toward the second reflector 130.

The second reflector 130 is a ring focus mirror having a mirror diameter of 1 m. The second reflector 130 receives the first radio wave and the second radio wave reflected by the first reflector 120, and reflects the first radio wave and the second radio wave in a predetermined direction.

The reflector antenna device 100 outputs the first radio wave and the second radio wave reflected by the second reflector 130 to the outside of the reflector antenna device 100.

Figure 6:
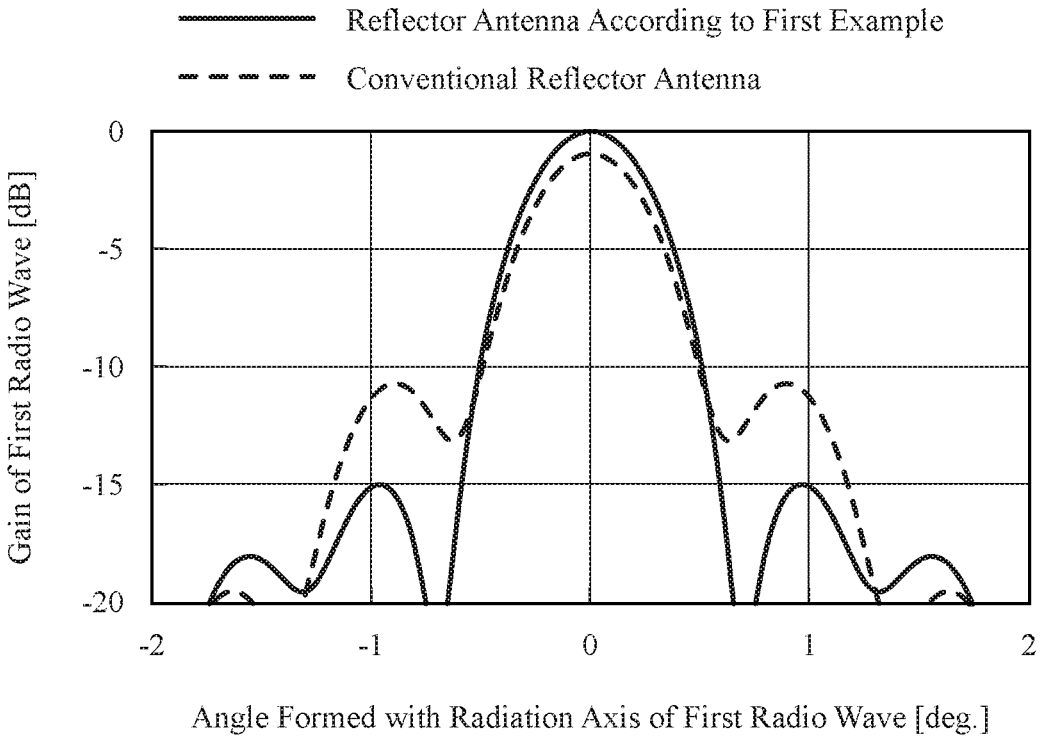
FIG. 6 is a secondary radiation pattern of the first radio wave output from the reflector antenna device according to the first example.

FIG. 6 is a diagram illustrating a secondary radiation pattern of the first radio wave output from the reflector antenna device 100 according to the first example, the secondary radiation pattern of the first radio wave after the first radio wave radiated by the primary radiator 110 included in the reflector antenna device 100 according to the first example is reflected by the first reflector 120 and the second reflector 130. FIG. 6 also illustrates a secondary radiation pattern of the first radio wave output from the conventional reflector antenna device for comparison with the secondary radiation pattern of the first radio wave output from the reflector antenna device 100 according to the first example.

The horizontal axis in FIG. 6 represents an angle formed with the radiation axis of the first radio wave output from the reflector antenna device 100. The vertical axis in FIG. 6 represents a gain of the first radio wave output from the reflector antenna device 100.

As illustrated in FIG. 6, the gain of the first radio wave output from the reflector antenna device 100 according to the first example is improved by about 1 dB in the radiation axis direction as compared with a gain of the first radio wave output from the conventional reflector antenna device.

As described above, the reflector antenna device 100 includes the primary radiator 110 to radiate the first radio wave that is the radio wave in the first frequency band and radiate the second radio wave that is the radio wave in the second frequency band lower in frequency than the first frequency band, and the first reflector 120 that is a reflector having the reflection face that receives the first radio wave and the second radio wave radiated by the primary radiator 110 and reflects the first radio wave and the second radio wave. The reflection face included in the first reflector 120 that is the reflector has the first region 121 including the center point of the reflection face and the second region 122 that is the outer peripheral region of the first region 121 and is the region provided with the plurality of recesses 123. Each of the plurality of recesses 123 provided in the second region 122 of the reflection face included in the first reflector 120 that is the reflector allows the first radio wave to enter the recess 123, restricts the second radio wave from entering the recess 123, and reflects the first radio wave that has entered the recess 123 on the bottom face 125 of the recess 123.

With such a configuration, the reflector antenna device 100 can suppress the spillover of the side lobe of the radio wave in the high frequency band while suppressing the decrease in the gain of the secondary radiation pattern of the radio wave in the high frequency band.

Furthermore, with such a configuration, the reflector antenna device 100 can improve the gain of the secondary radiation pattern of the radio wave in the high frequency band output from the reflector antenna device 100 by suppressing the spillover of the side lobe of the radio wave in the high frequency band.

Furthermore, as described above, in the above-described configuration, the reflector antenna device 100 is configured so that the maximum value "L" of the length in the plane parallel to the reflection face of each of the plurality of recesses 123 provided in the second region 122 of the reflection face included in the first reflector 120 that is a reflector falls within the range defined by the above-described formula (1).

With this configuration, each of the plurality of recesses 123 provided in the second region 122 of the reflection face included in the first reflector 120 that is a reflector can allow the first radio wave to enter the recess 123, restrict the second radio wave from entering the recess 123, and reflect the first radio wave that has entered the recess 123 on the bottom face 125 of the recess 123.

Furthermore, as described above, in the above-described configuration, the reflector antenna device 100 is configured so that each of the plurality of recesses 123 provided in the second region 122 of the reflection face included in the first reflector 120 that is a reflector enters the recess 123, and the phase of the first radio wave reflected on the bottom face 125 of the recess 123 is the same phase as the phase of the first radio wave reflected by the first region 121 of the reflection face included in the first reflector 120 that is a reflector at the opening 124 of the recess 123.

With such a configuration, the reflector antenna device 100 can suppress the spillover of the side lobe of the radio wave in the high frequency band while suppressing the decrease in the gain of the secondary radiation pattern of the radio wave in the high frequency band.

Furthermore, with such a configuration, the reflector antenna device 100 can improve the gain of the secondary radiation pattern of the radio wave in the high frequency band output from the reflector antenna device 100 by suppressing the spillover of the side lobe of the radio wave in the high frequency band.

Furthermore, as described above, in the above-described configuration, the reflector antenna device 100 is configured so that the depth of each of the plurality of recesses 123 provided in the second region 122 of the reflection face included in the first reflector 120 that is a reflector is an odd multiple of the ¼ wavelength of the first radio wave.

With such a configuration, the reflector antenna device 100 can suppress the spillover of the side lobe of the radio wave in the high frequency band while suppressing the decrease in the gain of the secondary radiation pattern of the radio wave in the high frequency band.

Furthermore, with such a configuration, the reflector antenna device 100 can improve the gain of the secondary radiation pattern of the radio wave in the high frequency band output from the reflector antenna device 100 by suppressing the spillover of the side lobe of the radio wave in the high frequency band.

Furthermore, as described above, in the above-described configuration, the reflector antenna device 100 is configured so that the reflection face included in the first reflector 120 that is a reflector is a quadratic face or a parabolic face.

With such a configuration, the reflector antenna device 100 can suppress the spillover of the side lobe of the radio wave in the high frequency band while suppressing the decrease in the gain of the secondary radiation pattern of the radio wave in the high frequency band.

Furthermore, with such a configuration, the reflector antenna device 100 can improve the gain of the secondary radiation pattern of the radio wave in the high frequency band output from the reflector antenna device 100 by suppressing the spillover of the side lobe of the radio wave in the high frequency band.

Furthermore, as described above, in the above-described configuration, the reflector antenna device 100 is configured so that the second region 122 of the reflection face included in the first reflector 120 that is a reflector is a region that receives the side lobe of the first radio wave radiated by the primary radiator 110 and the main lobe of the second radio wave radiated by the primary radiator 110.

With such a configuration, the reflector antenna device 100 can suppress the spillover of the side lobe of the radio wave in the high frequency band while suppressing the decrease in the gain of the secondary radiation pattern of the radio wave in the high frequency band.

Furthermore, with such a configuration, the reflector antenna device 100 can improve the gain of the secondary radiation pattern of the radio wave in the high frequency band output from the reflector antenna device 100 by suppressing the spillover of the side lobe of the radio wave in the high frequency band.

Modification of First Embodiment

The reflector antenna device 100 according to the first embodiment includes the primary radiator 110, the first reflector 120, and the second reflector 130 as illustrated in FIG. 1, but the reflector antenna device 100 may include one or more reflectors different from the first reflector 120 and the second reflector 130 in addition to the first reflector 120 and the second reflector 130.

More specifically, for example, in the reflector antenna device 100 according to a modification of the first embodiment, the first reflector 120 reflects the first radio wave and the second radio wave radiated by the primary radiator 110 toward a reflector different from the first reflector 120 and the second reflector 130. Furthermore, in the reflector antenna device 100 according to the modification of the first embodiment, the second reflector 130 receives the first radio wave and the second radio wave reflected by the reflector different from the first reflector 120 and the second reflector 130, and reflects the first radio wave and the second radio wave in a predetermined direction.

As described above, the reflector antenna device 100 according to the modification of the first embodiment includes the primary radiator 110 to radiate the first radio wave that is the radio wave in the first frequency band and radiate the second radio wave that is the radio wave in the second frequency band lower in frequency than the first frequency band, and the first reflector 120 that is the reflector having the reflection face that receives the first radio wave and the second radio wave radiated by the primary radiator 110 and reflects the first radio wave and the second radio wave. The reflection face included in the first reflector 120 that is the reflector has the first region 121 including the center point of the reflection face and the second region 122 that is the outer peripheral region of the first region 121 and is the region provided with the plurality of recesses 123. Each of the plurality of recesses 123 provided in the second region 122 of the reflection face included in the first reflector 120 that is a reflector is configured to allow the first radio wave to enter the recess 123, restrict the second radio wave from entering the recess 123, and reflect the first radio wave that has entered the recess 123 on the bottom face 125 of the recess 123.

With such a configuration, the reflector antenna device 100 according to the modification of the first embodiment can suppress the spillover of the side lobe of the radio wave in the high frequency band while suppressing the decrease in the gain of the secondary radiation pattern of the radio wave in the high frequency band.

Furthermore, with such a configuration, the reflector antenna device 100 according to the modification of the first embodiment can improve the gain of the secondary radiation pattern of the radio wave in the high frequency band output from the reflector antenna device 100 by suppressing the spillover of the side lobe of the radio wave in the high frequency band.

Another Modification of First Embodiment

The reflector antenna device 100 according to the first embodiment includes the primary radiator 110, the first reflector 120, and the second reflector 130 as illustrated in FIG. 1, but a reflector antenna device 100*a* may include only a first reflector 120*a* without including the second reflector 130.

That is, while the reflector antenna device 100 according to the first embodiment is a reflector antenna including a plurality of reflectors such as a Cassegrain antenna or a Gregorian antenna, the reflector antenna device 100*a* is a reflector antenna including one reflector such as a parabola antenna, an offset parabola antenna, or a horn reflector antenna.

A configuration of the reflector antenna device 100*a* according to another modification of the first embodiment will be described with reference to FIG. 7.

FIG. 7 is a configuration diagram illustrating an example of a configuration of a main part of the reflector antenna device 100*a* according to another modification of the first embodiment.

The reflector antenna device 100*a* includes a primary radiator 110 and a first reflector 120*a*.

Figure 7A:
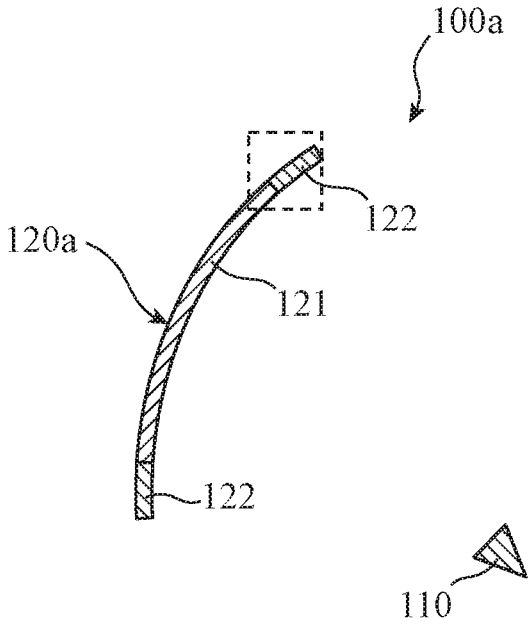
FIG. 7A is a configuration diagram illustrating an example of a configuration of a main part of a reflector antenna device according to another modification of the first embodiment.

FIG. 7A is a configuration diagram illustrating an example of a configuration of a main part of the reflector antenna device 100*a* according to another modification of the first embodiment, and is a cross-sectional view of the reflector antenna device 100*a* on a plane including a radiation axis of the primary radiator 110 included in the reflector antenna device 100*a*.

Figure 7C:
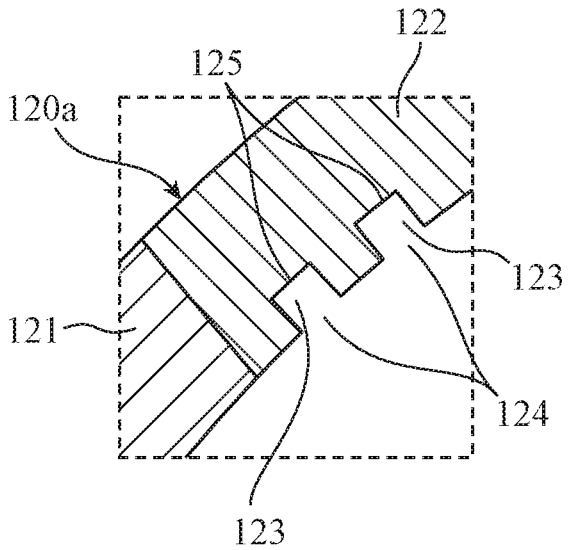
FIG. 7C is a configuration diagram illustrating the example of the configuration of the main part of the first reflector included in the reflector antenna device according to another modification of the first embodiment.
Figure 7B:
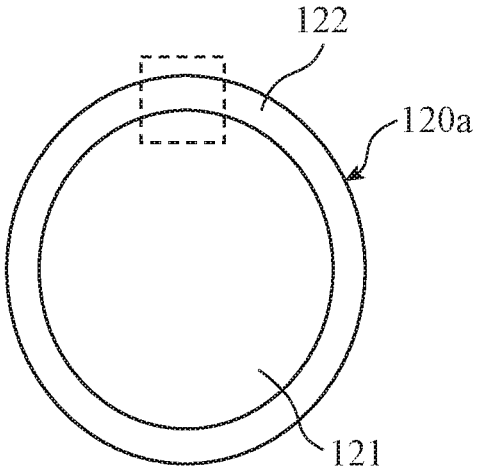
FIG. 7B is a configuration diagram illustrating an example of a configuration of a main part of a first reflector included in the reflector antenna device according to another modification of the first embodiment.

FIG. 7B is a configuration diagram illustrating an example of the configuration of the main part of the first reflector 120*a* included in the reflector antenna device 100*a* according to another modification of the first embodiment, and is a configuration diagram of the first reflector 120*a* viewed from the primary radiator 110 included in the reflector antenna device 100*a* according to another modification of the first embodiment.

FIG. 7C is a configuration diagram illustrating an example of a configuration of the main part of the first reflector 120*a* included in the reflector antenna device 100*a* according to another modification of the first embodiment, and is an enlarged view of the first reflector 120*a* in a region surrounded by a rectangle indicated by a broken line in FIG. 7A.

Figure 7D:
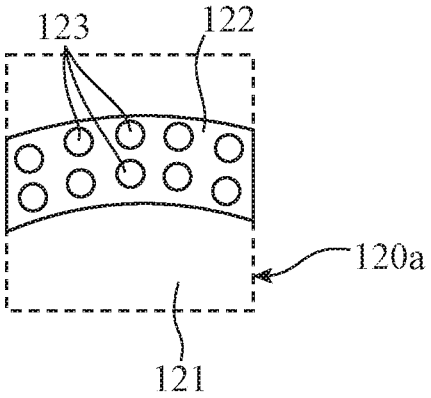
FIG. 7D is a configuration diagram illustrating the example of the configuration of the main part of the first reflector included in the reflector antenna device according to another modification of the first embodiment.

FIG. 7D is a configuration diagram illustrating an example of a configuration of the main part of the first reflector 120*a* included in the reflector antenna device 100*a* according to another modification of the first embodiment, and is an enlarged view of the first reflector 120*a* in a region surrounded by a rectangle indicated by a broken line in FIG. 7B.

In FIG. 7, the same reference numerals are given to the same blocks as those illustrated in FIG. 1, and the description thereof will be omitted.

The first reflector 120*a* is a reflector having a reflection face that receives the first radio wave and the second radio wave radiated from the primary radiator 110 and reflects the first radio wave and the second radio wave.

The reflection face included in the first reflector 120*a* that is a reflector is, for example, a curved face such as a quadratic face or a parabolic face.

For example, the first reflector 120*a* reflects the first radio wave and the second radio wave reflected by the first reflector 120*a* in a predetermined direction in which the reflector antenna device 100*a* outputs the first radio wave and the second radio wave.

The reflector antenna device 100*a* outputs the first radio wave and the second radio wave reflected by the first reflector 120*a* in a predetermined direction.

The reflection face included in the first reflector 120*a* that is a reflector includes a first region 121 including a center point of the reflection face, and a second region 122 that is an outer peripheral region of the first region 121 and is a region provided with a plurality of recesses 123.

The reflection face included in the first reflector 120*a* in the first region 121 corresponds to the reflection face in the first region 121 according to the first embodiment, and thus the description thereof is omitted.

In addition, the reflection face included in the first reflector 120*a* in the second region 122 corresponds to the reflection face in the second region 122 according to the first embodiment, and thus description thereof is omitted.

In addition, the plurality of recesses 123 provided on the reflection face included in the first reflector 120*a* in the second region 122 correspond to the plurality of recesses 123 according to the first embodiment, and thus description thereof is omitted.

As described above, the reflector antenna device 100*a* includes the primary radiator 110 to radiate the first radio wave that is the radio wave in the first frequency band and radiate the second radio wave that is the radio wave in the second frequency band lower in frequency than the first frequency band, and the first reflector 120*a* that is the reflector having the reflection face that receives the first radio wave and the second radio wave radiated by the primary radiator 110 and reflects the first radio wave and the second radio wave. The reflection face included in the first reflector 120*a* that is the reflector has the first region 121 including the center point of the reflection face and the second region 122 that is the outer peripheral region of the first region 121 and is the region provided with the plurality of recesses 123. Each of the plurality of recesses 123 provided in the second region 122 of the reflection face included in the first reflector 120*a* that is the reflector is configured to allow the first radio wave to enter the recess 123, restrict the second radio wave from entering the recess 123, and reflect the first radio wave that has entered the recess 123 on the bottom face 125 of the recess 123.

With this configuration, the reflector antenna device 100*a* can suppress the spillover of the side lobe of the radio wave in the high frequency band while suppressing the decrease in the gain of the secondary radiation pattern of the radio wave in the high frequency band.

Furthermore, with such a configuration, the reflector antenna device 100*a* can improve the gain of the secondary radiation pattern of the radio wave in the high frequency band output from the reflector antenna device 100*a* by suppressing the spillover of the side lobe of the radio wave in the high frequency band.

Second Embodiment

The primary radiator 110 included in the reflector antenna device 100 according to the first embodiment is a radiator that radiates the first radio wave that is the radio wave in the first frequency band and radiates the second radio wave that is the radio wave in the second frequency band lower in frequency than the first frequency band. However, the primary radiator 110 may be a radiator that radiates the first radio wave and the second radio wave and radiates a third radio wave that is a radio wave in a third frequency band lower in frequency than the first frequency band and higher in frequency than the second frequency band.

A configuration of a reflector antenna device 100*b* according to a second embodiment will be described with reference to FIG. 8.

FIG. 8 is a configuration diagram illustrating an example of a configuration of a main part of the reflector antenna device 100*b* according to the second embodiment.

The reflector antenna device 100*b* includes a primary radiator 110*b*, a first reflector 120*b*, and a second reflector 130.

The reflector antenna device 100*b* is, for example, a reflector antenna including a plurality of reflectors such as a Gregorian antenna or a Cassegrain antenna. In the second embodiment, the reflector antenna device 100*b* will be described as a Gregorian antenna as illustrated in FIG. 8 as an example. The reflector antenna device 100*b* may be a reflector antenna having one reflector such as a parabolic antenna, an offset parabolic antenna, or a horn reflector antenna. In a case where the reflector antenna device 100*b* is a reflector antenna including one reflector, the second reflector 130 is not an essential configuration in the reflector antenna device 100*b*.

Figure 8A:
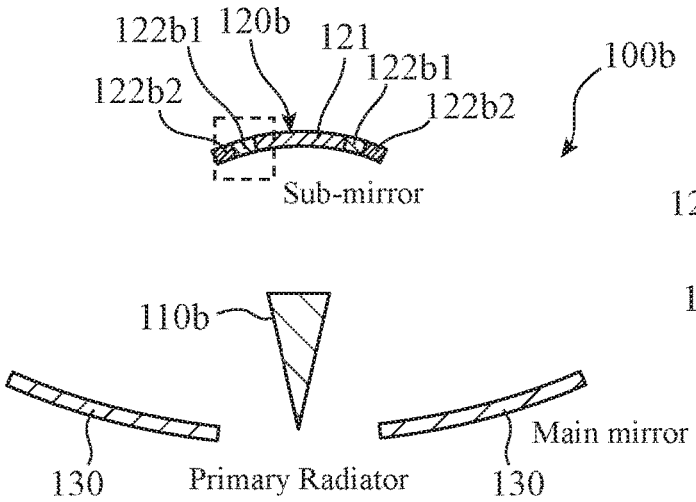
FIG. 8A is a diagram illustrating an example of a configuration of a main part of a reflector antenna device according to a second embodiment.

FIG. 8A is a configuration diagram illustrating an example of a configuration of a main part of the reflector antenna device 100*b* according to the second embodiment, and is a cross-sectional view of the reflector antenna device 100*b* on a plane including a radiation axis of the primary radiator 110*b* included in the reflector antenna device 100*b*.

Figure 8C:
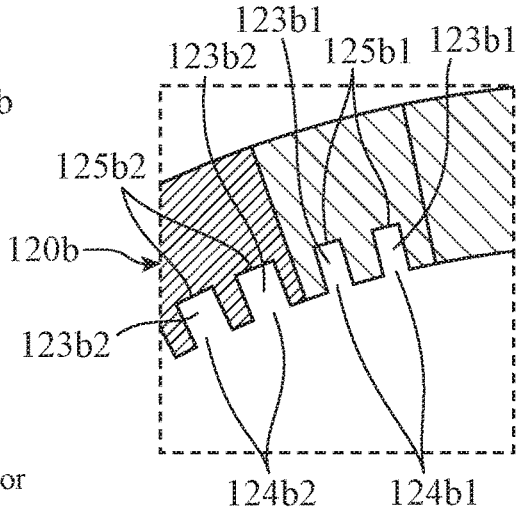
FIG. 8C is a configuration diagram illustrating the example of the configuration of the main part of the first reflector included in the reflector antenna device according to the second embodiment.
Figure 8B:
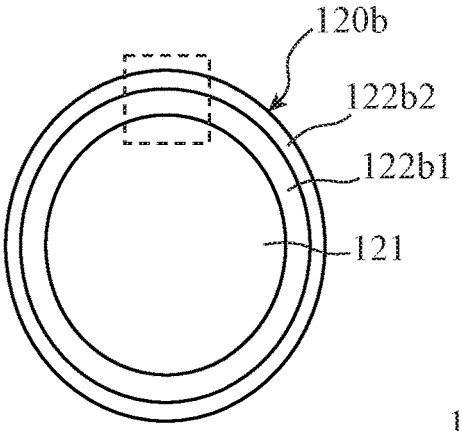
FIG. 8B is a configuration diagram illustrating an example of a configuration of a main part of a first reflector included in the reflector antenna device according to the second embodiment.

FIG. 8B is a configuration diagram illustrating an example of the configuration of a main part of the first reflector 120*b* included in the reflector antenna device 100*b* according to the second embodiment, and is a configuration diagram of the first reflector 120*b* viewed from the primary radiator 110*b* included in the reflector antenna device 100*b* according to the second embodiment.

FIG. 8C is a configuration diagram illustrating the example of the configuration of the main part of the first reflector 120*b* included in the reflector antenna device 100*b* according to the second embodiment, and is an enlarged view of the first reflector 120*b* in a region surrounded by a rectangle indicated by a broken line in FIG. 8A.

Figure 8D:
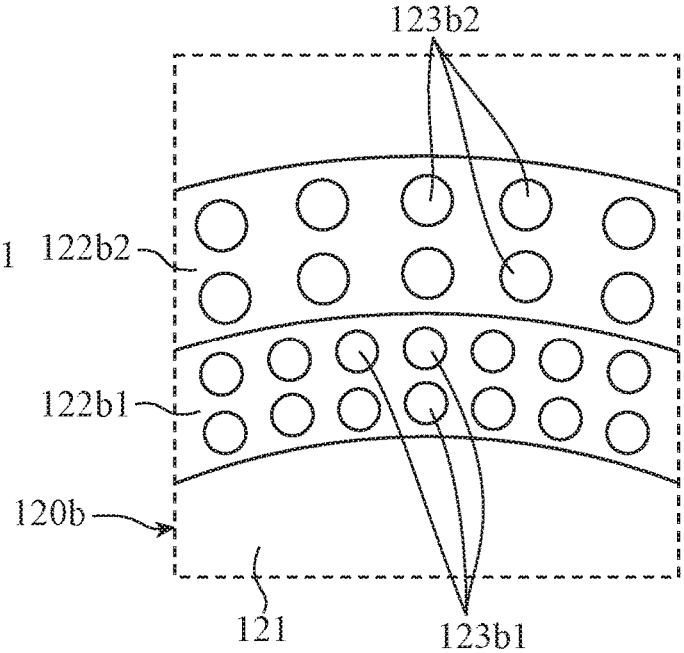
FIG. 8D is a configuration diagram illustrating the example of the configuration of the main part of the first reflector included in the reflector antenna device according to the second embodiment.

FIG. 8D is a configuration diagram illustrating the example of the configuration of the main part of the first reflector 120*b* included in the reflector antenna device 100*b* according to the second embodiment, and is an enlarged view of the first reflector 120*b* in a region surrounded by a rectangle indicated by a broken line in FIG. 8B.

In FIG. 8, the same reference numerals are given to the same blocks as those illustrated in FIG. 1, and the description thereof will be omitted.

The primary radiator 110*b* is a radiator that radiates a first radio wave that is a radio wave in a first frequency band, a second radio wave that is a radio wave in a second frequency band lower in frequency than the first frequency band, and a third radio wave that is a radio wave in the third frequency band lower in frequency than the first frequency band and higher in frequency than the second frequency band.

In the second embodiment, the primary radiator 110*b* is described as one radiator that radiates the first radio wave, the second radio wave, and the third radio wave, but the primary radiator 110*b* may be a radiator in which three radiators are combined, such as a radiator in which a radiator that radiates the first radio wave, another radiator that radiates the second radio wave, and another radiator that radiates the third radio wave are combined.

The first reflector 120*b* is a reflector having a reflection face that receives the first radio wave, the second radio wave, and the third radio wave radiated by the primary radiator 110*b* and reflects the first radio wave, the second radio wave, and the third radio wave.

In the reflector antenna device 100*b* according to the second embodiment, the first reflector 120*b* is a sub-mirror.

The reflection face included in the first reflector 120*b* that is a reflector is, for example, a curved face such as a quadratic face or a parabolic face.

The reflection face included in the first reflector 120*b* that is a reflector includes a first region 121 including a center point of the reflection face, a second region **122*b*1 that is an outer peripheral region of the first region 121 and is a region provided with a plurality of recesses 123*b*1, and a third region 122*b*2 that is an outer peripheral region of the second region 122*b*1 and is a region provided with a plurality of recesses 123*b*2**.

Note that the plurality of recesses **123*b*1 provided on the reflection face in the second region 122*b*1 may be periodically arranged or may be arranged at any positions in the second region 122*b*1. In addition, the plurality of recesses 123*b*2 provided on the reflection face in the third region 122*b*2 may be periodically arranged, or may be arranged at any positions in the third region 122*b*2**.

The reflection face included in the first reflector **120*b* in the first region 121 is made of, for example, a conductor such as metal, and the reflection face in the first region 121** is processed into a smooth shape without unevenness.

The reflection face in the first region 121 receives a main lobe of the first radio wave radiated by the primary radiator **110*b*, a main lobe of the second radio wave radiated by the primary radiator 110*b*, and a main lobe of the third radio wave radiated by the primary radiator 110*b*. The reflection face in the first region 121 reflects the main lobe of the first radio wave, the main lobe of the second radio wave, and the main lobe of the third radio wave toward the second reflector 130**.

The reflection face included in the first reflector **120*b* in the second region 122*b*1 is made of, for example, a conductor such as metal, and the plurality of recesses 123*b*1 (hereinafter, simply referred to as a "plurality of recesses 123*b*1") provided in the reflection face in the second region 122*b*1** is formed by casting, shaving, or tapping.

The reflection face in the second region **122*b*1 receives a side lobe of the first radio wave radiated by the primary radiator 110*b*, the main lobe of the second radio wave radiated by the primary radiator 110*b*, and the main lobe of the third radio wave radiated by the primary radiator 110*b***.

Each of the plurality of recesses **123*b*1 allows the first radio wave to enter the recess 123*b*1, restricts the second radio wave and the third radio wave from entering the recess 123*b*1, and reflects the first radio wave having entered the recess 123*b*1 on a bottom face 125*b*1 of the recess 123*bl***.

Specifically, each of the plurality of recesses **123*b*1 allows the side lobe of the first radio wave radiated by the primary radiator 110*b* to enter the recess 123*b*1, and reflects the side lobe of the first radio wave having entered the recess 123*b*1 on the bottom face 125*b*1 of the recess 123*b*1. More specifically, each of the plurality of recesses 123*b*1 reflects the side lobe of the first radio wave having entered the recess 123*b*1 toward the second reflector 130. In addition, each of the plurality of recesses 123*b*1 restricts the main lobe of the second radio wave and the main lobe of the third radio wave radiated by the primary radiator 110*b* from entering the recess 123*b*1, and reflects the main lobe of the second radio wave and the main lobe of the third radio wave not entering the recess 123*b*1 toward the second reflector 130**.

The reflection face included in the first reflector **120*b* in the third region 122*b*2 is made of, for example, a conductor such as metal, and the plurality of recesses 123*b*2 (hereinafter, simply referred to as a "plurality of recesses 123*b*2") provided in the reflection face in the third region 122*b*2** is formed by casting, shaving, or tapping.

The reflection face in the third region **122*b*2 receives the side lobe of the first radio wave radiated by the primary radiator 110*b*, the main lobe of the second radio wave radiated by the primary radiator 110*b*, and a side lobe of the third radio wave radiated by the primary radiator 110*b***.

Each of the plurality of recesses **123*b*2 allows the first radio wave and the third radio wave to enter the recess 123*b*2, restricts the second radio wave from entering the recess 123*b*2, and reflects the first radio wave and the third radio wave having entered the recess 123*b*2 on a bottom face 125*b*2 of the recess 123*b*2**.

Specifically, each of the plurality of recesses **123*b*2 allows the side lobe of the first radio wave radiated by the primary radiator 110*b* and the side lobe of the third radio wave radiated by the primary radiator 110*b* to enter the recess 123*b*2, and reflects the side lobe of the first radio wave and the side lobe of the third radio wave having entered the recess 123*b*2 on the bottom face 125*b*2 of the recess 123*b*2. More specifically, each of the plurality of recesses 123*b*2 reflects the side lobe of the first radio wave and the side lobe of the third radio wave having entered the recess 123*b*2 toward the second reflector 130. Each of the plurality of recesses 123*b*2 restricts the main lobe of the second radio wave radiated by the primary radiator 110*b* from entering the recess 123*b*2, and reflects the main lobe of the second radio wave not entering the recess 123*b*2 toward the second reflector 130**.

With this configuration, the reflector antenna device **100*b*** can suppress the spillover of the side lobe of the radio wave in the high frequency band while suppressing the decrease in the gain of the secondary radiation pattern of the radio wave in the high frequency band.

Each of the plurality of recesses **123*b*1 and each of the plurality of recesses 123*b*2 have, for example, a circular shape in a cross section in a plane parallel to the reflection face. That is, each of the plurality of recesses 123*b*1 and each of the plurality of recesses 123*b*2 are cylindrical recesses provided on the reflection face in the second region 122*b*1 or the third region 122*b*2 included in the first reflector 120*b***.

The shape of the cross section in the plane parallel to the reflection face of each of the plurality of recesses **123*b*1 and each of the plurality of recesses 123*b*2** is not limited to a circular shape.

As illustrated in FIG. 2, the shape of the cross section in the plane parallel to the reflection face of each of the plurality of recesses **123*b*1 and each of the plurality of recesses 123*b*2 may be an elliptical shape, a rectangular shape, a doughnut shape, a cross shape, or the like. The plurality of recesses 123*b*1 and the plurality of recesses 123*b*2** may be a combination of recesses having different cross-sectional shapes in a plane parallel to the reflection face.

The second reflector 130 is a reflector having a reflection face that receives the first radio wave, the second radio wave, and the third radio wave reflected by the first reflector **120*b*** and reflects the first radio wave and the second radio wave.

In the reflector antenna device **100*b* according to the second embodiment, the second reflector 130** is a main mirror.

For example, the second reflector 130 reflects the first radio wave, the second radio wave, and the third radio wave reflected by the first reflector **120*b* in a predetermined direction in which the reflector antenna device 100*b*** outputs the first radio wave, the second radio wave, and the third radio wave.

The reflector antenna device **100*b* outputs the first radio wave, the second radio wave, and the third radio wave reflected by the second reflector 130** in a predetermined direction.

The maximum value "La" of the length in the plane parallel to the reflection face of each of the plurality of recesses **123*b*1** falls, for example, within a range defined by the following formula (2).

$$\frac{C_x}{\pi F_H} < L < \frac{C_x}{\pi F_M} \tag{2}$$

In addition, the maximum value "Lb" of the length in the plane parallel to the reflection face of each of the plurality of recesses **123*b*2** falls, for example, within a range defined by the following formula (3).

$$\frac{C_x}{\pi F_M} < L < \frac{C_x}{\pi F_L} \tag{3}$$

Here, "C" is the speed of light, "χ" is the positive minimum root in the first derivative of the Bessel function of the first type, "π" is the circular constant, "FH" is the first frequency band, "FL" is the second frequency band, and "FM" is the third frequency band.

Note that the value of χ, which is the positive minimum root in the first derivative of the Bessel function of the first type, is 1.841.

For example, in a case where the maximum value of the length in the plane parallel to the reflection face of each of the plurality of recesses **123*b*1 satisfies the condition shown in formula (2), the second radio wave in the second frequency band and the third radio wave in the third frequency band having frequencies lower than that of the first frequency band which is the high frequency band are reflected at an opening 124*b*1 of each recess 123*b*1** since the maximum value of the length is shorter than the wavelengths of the second radio wave and the third radio wave.

On the other hand, in this case, since the maximum value of the length is longer than the wavelength of the first radio wave, the first radio wave in the first frequency band that is a high frequency band enters the inside of each recess **123*b*1 and is reflected on the bottom face 125*b*1 of each recess 123*b*1 facing the opening 124*b*1 of each recess 123*b*1**.

In addition, for example, in a case where the maximum value of the length in the plane parallel to the reflection face of each of the plurality of recesses **123*b*2 satisfies the condition shown in formula (3), the second radio wave in the second frequency band having a frequency lower than that of the third frequency band, which is a high frequency band, is reflected at an opening 124*b*2 of each recess 123*b*2** since the maximum value of the length is shorter than the wavelength of the third radio wave.

On the other hand, in this case, since the maximum value of the length is longer than the wavelengths of the first radio wave and the third radio wave, the first radio wave in the first frequency band and the third radio wave in the third frequency band, which are high frequency bands, enter the inside of each recess **123*b*2, and are reflected on the bottom face 125*b*2 of each recess 123*b*2 facing the opening 124*b*2 of each recess 123*b*2**.

For example, the plurality of recesses **123*b*1** are processed so that the depth of each recess is an odd multiple of ¼ wavelength of the first radio wave.

Note that the depth of each of the plurality of recesses **123*b*1** does not need to be strictly ¼ wavelength of the first radio wave, and the ¼ wavelength of the first radio wave herein includes approximately ¼ wavelength.

Further, as for the depths of the plurality of recesses **123*b*1, the depths of all of the plurality of recesses 123*b*1** do not need to be ¼ wavelength of the first radio wave, and may be, for example, any depth depending on the distance from the center point of the reflection face or the like.

In a case where the depth of each of the plurality of recesses **123*b*1 is an odd multiple of ¼ wavelength of the first radio wave, the phase of the first radio wave reflected on the bottom face 125*b*1 of the recess 123*b*1 is inverted with respect to the phase of the first radio wave incident on the recess 123*b*1 at the opening 124*b*1 of the recess 123*bl*.**

The depth of the recess **123*b*1 is a distance from the opening 124*b*1 of the recess 123*b*1 to the bottom face 125*b*1 of the recess 123*b*1**.

For example, the plurality of recesses **123*b*2** are processed so that the depth of each recess is an odd multiple of ¼ wavelength of the first radio wave or an odd multiple of ¼ wavelength of the third radio wave.

Note that the depth of each of the plurality of recesses **123*b*2** does not need to be strictly ¼ wavelength of the first radio wave or the third radio wave, and the ¼ wavelength of the first radio wave or the third radio wave here includes approximately ¼ wavelength.

For example, the plurality of recesses **123*b*2** may be processed so that the depth of each recess is an odd multiple of the ¼ wavelength of the first radio wave and an odd multiple of the ¼ wavelength of the third radio wave.

For example, the plurality of recesses **123*b*2** may be processed so that the depth of each recess is substantially odd multiple of ¼ wavelength of the first radio wave and substantially odd multiple of ¼ wavelength of the third radio wave.

Further, as for the depths of the plurality of recesses **123*b*2, the depths of all of the plurality of recesses 123*b*2** do not need to be ¼ wavelength of the first radio wave or the third radio wave, and may be, for example, any depth depending on the distance from the center point of the reflection face or the like.

In a case where the depth of each of the plurality of recesses **123*b*2 is an odd multiple of ¼ wavelength of the first radio wave, the phase of the first radio wave reflected on the bottom face 125*b*2 of the recess 123*b*2 is inverted with respect to the phase of the first radio wave incident on the recess 123*b*2 at the opening 124*b*2 of the recess 123*b*2**.

In a case where the depth of each of the plurality of recesses **123*b*2 is an odd multiple of ¼ wavelength of the third radio wave, the phase of the third radio wave reflected on the bottom face 125*b*2 of the recess 123*b*2 is inverted with respect to the phase of the third radio wave incident on the recess 123*b*2 at the opening 124*b*2 of the recess 123*b*2**.

In a case where the depth of each of the plurality of recesses **123*b*2 is approximately an odd multiple of the ¼ wavelength of the first radio wave and approximately an odd multiple of the ¼ wavelength of the third radio wave, the phases of the first radio wave and the third radio wave reflected on the bottom face 125*b*2 of the recess 123*b*2 are substantially inverted with respect to the phases of the first radio wave and the third radio wave incident on the recess 123*b*2 at the opening 124*b*2 of the recess 123*b*2**.

Note that the depth of the recess **123*b*2 is a distance from the opening 124*b*2 of the recess 123*b*2 to the bottom face 125*b*2 of the recess 123*b*2**.

The detailed behavior of the recess **123*b*1 and the recess 123*b*2 is similar to that of the recess 123** according to the first embodiment, and thus the detailed description thereof is omitted.

As described above, the reflector antenna device 100*b* includes the primary radiator 110*b* to radiate the first radio wave that is the radio wave in the first frequency band and radiate the second radio wave that is the radio wave in the second frequency band lower in frequency than the first frequency band and the third radio wave that is the radio wave in the third frequency band lower in frequency than the first frequency band and higher in frequency than the second frequency band, and the first reflector 120*b* that is the reflector having the reflection face that receives the first radio wave, the second radio wave, and the third radio wave radiated by the primary radiator 110*b* and reflects the first radio wave, the second radio wave, and the third radio wave. The reflection face included in the first reflector 120*b* that is the reflector has the first region 121 including the center point of the reflection face, the second region 122*b*1 that is the outer peripheral region of the first region 121 and is a region provided with the plurality of recesses 123*b*1, and the third region 122*b*2 that is the outer peripheral region of the second region 122*b*1 and is a region provided with the plurality of recesses 123*b*2. Each of the plurality of recesses 123*b*1 provided in the second region 122*b*1 of the reflection face included in the first reflector 120*b* that is a reflector is configured to allow the first radio wave to enter the recess 123*b*1, restrict the second radio wave and the third radio wave from entering the recess 123*b*1, and reflect the first radio wave that has entered the recess 123*b*1 on the bottom face 125*b*1 of the recess 123*b*1. Each of the plurality of recesses 123*b*2 provided in the third region 122*b*2 of the reflection face included in the first reflector 120*b* that is a reflector is configured to allow the first radio wave and the third radio wave to enter the recess 123*b*2, restrict the second radio wave from entering the recess 123*b*2, and reflect the first radio wave and the third radio wave that have entered the recess 123*b*2 on the bottom face 125*b*2 of the recess 123*b*2.

With this configuration, the reflector antenna device 100*b* can suppress the spillover of the side lobe of the radio wave in the high frequency band while suppressing the decrease in the gain of the secondary radiation pattern of the radio wave in the high frequency band.

Furthermore, with such a configuration, the reflector antenna device 100*b* can improve the gain of the secondary radiation pattern of the radio wave in the high frequency band output from the reflector antenna device 100*b* by suppressing the spillover of the side lobe of the radio wave in the high frequency band.

Third Embodiment

A configuration of a main part of a reflector antenna device 100*c* according to a third embodiment will be described with reference to FIG. 9.

FIG. 9 is a configuration diagram illustrating an example of the configuration of the main part of the reflector antenna device 100*c* according to the third embodiment.

The reflector antenna device 100*c* includes a primary radiator 110, a first reflector 120*c*, and a second reflector 130.

The reflector antenna device 100*c* is, for example, a reflector antenna including a plurality of reflectors such as a Gregorian antenna or a Cassegrain antenna. In the third embodiment, the reflector antenna device 100*c* will be described as a Gregorian antenna as illustrated in FIG. 9 as an example. Note that the reflector antenna device 100*c* may be a reflector antenna having one reflector such as a parabolic antenna, an offset parabolic antenna, or a horn reflector antenna. In a case where the reflector antenna device 100*c* is a reflector antenna including one reflector, the second reflector 130 is not an essential configuration in the reflector antenna device 100*c*.

Figure 9A:
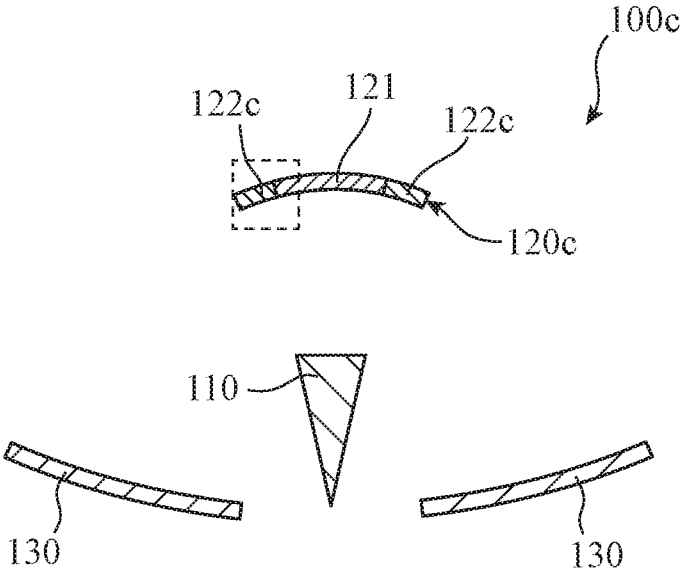
FIG. 9A is a configuration diagram illustrating an example of a configuration of a main part of a reflector antenna device according to a third embodiment.

FIG. 9A is a configuration diagram illustrating an example of the configuration of the main part of the reflector antenna device 100*c* according to the third embodiment, and is a cross-sectional view of the reflector antenna device 100*c* on a plane including the radiation axis of the primary radiator 110 included in the reflector antenna device 100*c*.

Figure 9C:
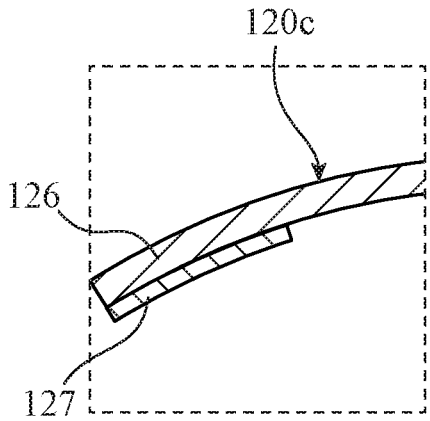
FIG. 9C is a configuration diagram illustrating an example of a configuration of the main part of the first reflector included in the reflector antenna device according to the third embodiment.
Figure 9B:
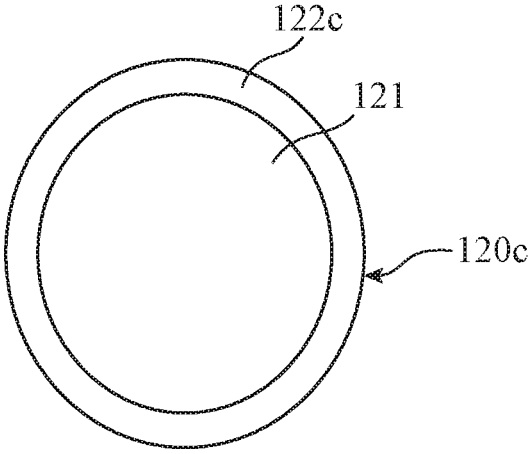
FIG. 9B is a configuration diagram illustrating an example of a configuration of a main part of a first reflector included in the reflector antenna device according to the third embodiment.

FIG. 9B is a configuration diagram illustrating an example of the configuration of the main part of the first reflector 120*c* included in the reflector antenna device 100*c* according to the third embodiment, and is a configuration diagram of the first reflector 120*c* viewed from the primary radiator 110 included in the reflector antenna device 100*c* according to the third embodiment.

FIG. 9C is a configuration diagram illustrating an example of a configuration of a main part of the first reflector 120*c* included in the reflector antenna device 100*c* according to the third embodiment, and is an enlarged view of the first reflector 120*c* in a region surrounded by a rectangle indicated by a broken line in FIG. 9A.

In FIG. 9, the same reference numerals are given to the same blocks as those illustrated in FIG. 1, and the description thereof will be omitted.

The primary radiator 110 is a radiator that radiates a first radio wave that is a radio wave in a first frequency band and radiates a second radio wave that is a radio wave in a second frequency band lower in frequency than the first frequency band.

The first reflector 120*c* is a reflector having a reflection face that receives the first radio wave and the second radio wave radiated by the primary radiator 110 and reflects the first radio wave and the second radio wave.

In the reflector antenna device 100*c* according to the third embodiment, the first reflector 120*c* is a sub-mirror.

The reflection face included in the first reflector 120*c* that is a reflector is, for example, a curved face such as a quadratic face or a parabolic face.

The reflection face included in the first reflector 120*c* that is a reflector includes a first region 121 including a center point of the reflection face, and a second region 122*c* that is an outer peripheral region of the first region 121 and is a region including a conductor 126 and a dielectric 127 provided on the conductor 126.

The reflection face in the first region 121 (hereinafter, simply referred to as a "first region 121") included in the first reflector 120*c* is made of, for example, a conductor such as metal, and the reflection face in the first region 121 is processed into a smooth shape without unevenness.

The reflection face in the first region 121 receives a main lobe of the first radio wave radiated by the primary radiator 110 and a main lobe of the second radio wave radiated by the primary radiator 110. The reflection face in the first region 121 reflects the main lobe of the first radio wave and the main lobe of the second radio wave toward the second reflector 130.

In the conductor 126 (hereinafter, simply referred to as a "conductor 126") constituting the reflection face in the second region 122*c* (hereinafter, simply referred to as a "second region 122*c*") included in the first reflector 120*c*, the face of the conductor 126 in contact with the dielectric 127 is processed into a smooth shape without unevenness, and is disposed on the same curved face as the curved face formed by the reflection face in the first region 121.

The conductor 126 may be the same member as the conductor constituting the reflection face in the first region 121, or may be a member different from the conductor constituting the reflection face in the first region 121.

A face in contact with the conductor 126 of the dielectric 127 (hereinafter, simply referred to as a "dielectric 127") constituting the reflection face in the second region 122*c* and a face facing the face and receiving the first radio wave and the second radio wave radiated by the primary radiator 110 are both processed into a smooth shape without unevenness.

The dielectric 127 receives the first radio wave and the second radio wave radiated by the primary radiator 110 and transmits the first radio wave and the second radio wave.

The conductor 126 reflects the first radio wave and the second radio wave transmitted through the dielectric 127.

The second region 122*c* reflects the first radio wave and the second radio wave radiated by the primary radiator 110 by transmitting the first radio wave and the second radio wave reflected by the conductor 126 through the dielectric 127 again and radiating the first radio wave and the second radio wave.

The dielectric 127 increases the phase of the first radio wave reflected by the second region 122*c* by an odd multiple of 180 degrees with respect to the phase of the first radio wave reflected by the second region 122*c* in a case where the second region 122*c* does not have the dielectric 127, and increases the phase of the second radio wave reflected by the second region 122*c* by an even multiple of 180 degrees with respect to the phase of the second radio wave reflected by the second region 122*c* in a case where the second region 122*c* does not have the dielectric 127.

It should be noted that 180 degrees referred to herein need not be strictly 180 degrees and include approximately 180 degrees.

The dielectric 127 has a thickness calculated based on the following formula (4).

$$\phi = 2 \times \frac{360\,D\left(\sqrt{\varepsilon_r} - 1\right)}{\lambda} \tag{4}$$

Here, "D" is the thickness of the dielectric 127, "εr" is the relative permittivity of the dielectric 127, "λ" is the wavelength of the radio wave, and "φ" is the amount of increase in the phase of the radio wave reflected by the second region 122*c* with respect to the phase of the radio wave reflected by the second region 122*c* in a case where the second region 122*c* does not have the dielectric 127.

The behaviors of the first radio wave and the second radio wave incident on the second region 122*c* according to the third embodiment will be described with reference to FIG. 10.

Figure 10A:
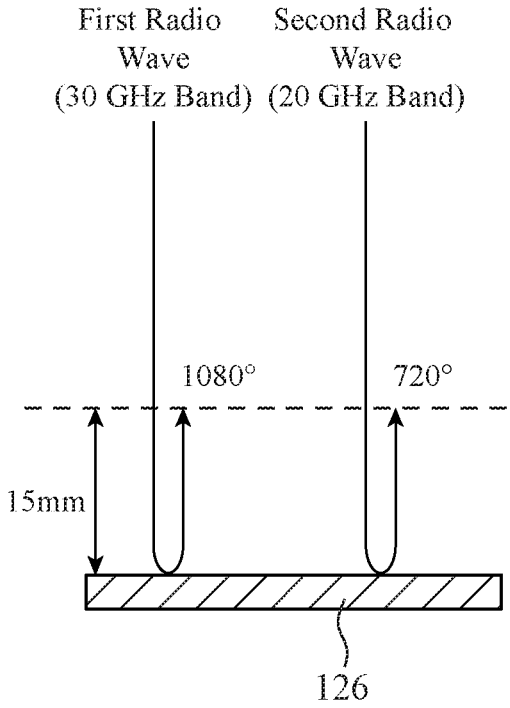
FIG. 10A is a diagram illustrating an example of behaviors of a first radio wave and a second radio wave incident on a second region in a case where the second region according to the third embodiment does not include a dielectric.

FIG. 10A is a diagram illustrating an example of behaviors of the first radio wave and the second radio wave incident on the second region 122*c* in a case where the second region 122*c* according to the third embodiment does not have the dielectric 127.

Figure 10B:
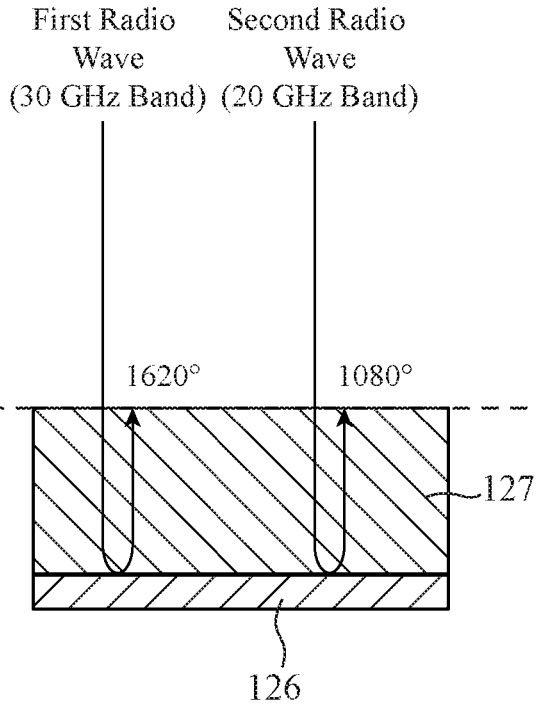
FIG. 10B is a diagram illustrating an example of behaviors of the first radio wave and the second radio wave incident on the dielectric constituting a reflection face in the second region according to the third embodiment.

FIG. 10B is a diagram illustrating an example of behaviors of the first radio wave and the second radio wave incident on the dielectric 127 constituting the reflection face in the second region 122*c* according to the third embodiment.

As an example, the dielectric 127 illustrated in FIG. 10B has a relative permittivity of 2.25 and a thickness of 15 mm (millimeters).

As an example, the frequency band of the first radio wave illustrated in FIGS. 10A and 10B is 30 GHz, and the frequency band of the second radio wave is 20 GHz.

Assuming that the light speed is $3.0\times10^{8}$ m per second, the wavelength of the first radio wave is $1.0\times10^{-2}$ m, and the wavelength of the first radio wave is $1.5\times10^{-2}$ m.

Therefore, as illustrated in FIG. 10B, the phase of the first radio wave advances by 1620 degrees while the first radio wave advances by 30 mm through the dielectric 127 having a relative permittivity of 2.25, and the phase of the second radio wave advances by 1080 degrees while the second radio wave advances by 30 mm through the dielectric 127. As illustrated in FIG. 10A, the phase of the first radio wave advances by 1080 degrees while the first radio wave advances by 30 mm in vacuum or air, and the phase of the second radio wave advances by 720 degrees while the second radio wave advances by 30 mm in vacuum or air.

That is, the dielectric 127 illustrated in FIG. 10B increases the phase of the first radio wave reflected by the second region 122*c* by 540 degrees, which is an odd multiple of 180 degrees with respect to the phase of the first radio wave reflected by the second region 122*c* in a case where the second region 122*c* does not have the dielectric 127, and increases the phase of the second radio wave reflected by the second region 122*c* by 360 degrees, which is an even multiple of 180 degrees with respect to the phase of the second radio wave reflected by the second region 122*c* in a case where the second region 122*c* does not have the dielectric 127.

The side lobe closest to the main lobe has a phase inverted with respect to the main lobe.

As described above, the reflection face in the first region 121 receives the main lobe of the first radio wave radiated by the primary radiator 110 and the main lobe of the second radio wave radiated by the primary radiator 110. As described above, the reflection face in the second region 122*c* receives the side lobe of the first radio wave radiated by the primary radiator 110 and the main lobe of the second radio wave radiated by the primary radiator 110.

Therefore, in a case where the dielectric 127 increases the phase of the first radio wave reflected by the second region 122*c* by an odd multiple of 180 degrees with respect to the phase of the first radio wave reflected by the second region 122*c* in a case where the second region 122*c* does not have the dielectric 127, and increases the phase of the second radio wave reflected by the second region 122*c* by an even multiple of 180 degrees with respect to the phase of the second radio wave reflected by the second region 122*c* in a case where the second region 122*c* does not have the dielectric 127, the side lobe of the first radio wave reflected by the second region 122*c* has the same phase as the main lobe of the first radio wave reflected by the reflection face in the first region 121. In this case, the main lobe of the second radio wave reflected by the second region 122*c* has the same phase as the main lobe of the first radio wave reflected by the reflection face in the first region 121.

Note that the same phase referred to herein does not need to be strictly the same phase, and includes substantially the same phase.

In addition, the reflector antenna device 100*c* according to the third embodiment has been described as including the primary radiator 110, the first reflector 120*c*, and the second reflector 130 as an example, but it is not limited thereto.

For example, the reflector antenna device 100*c* according to the third embodiment may include, as the reflectors, one or more reflectors different from the first reflector 120*c* and the second reflector 130, in addition to the first reflector 120*c* and the second reflector 130.

Furthermore, for example, the reflector antenna device 100*c* according to the third embodiment may not include the second reflector 130, and may include only the first reflector 120*c* as a reflector with the first reflector 120*c* as a main mirror.

Furthermore, for example, the primary radiator 110 included in the reflector antenna device 100*c* according to the third embodiment is a radiator that radiates the first radio wave that is a radio wave in the first frequency band and radiates the second radio wave that is a radio wave in the second frequency band lower in frequency than the first frequency band. However, the primary radiator 110 may be a radiator that radiates the first radio wave and the second radio wave and radiates the third radio wave that is a radio wave in the third frequency band lower in frequency than the first frequency band and higher in frequency than the second frequency band.

In a case where the primary radiator 110 included in the reflector antenna device 100*c* according to the third embodiment radiates the first radio wave, the second radio wave, and the third radio wave, the reflection face included in the first reflector 120*c* according to the third embodiment may include a third region that is an outer peripheral region of the second region 122*c* or a third region that is an outer peripheral region of the first region 121 and an inner peripheral region of the second region 122*c* in addition to the first region 121 and the second region 122*c*. Further, the third region of the reflection face included in the first reflector 120*c* (hereinafter, simply referred to as a "third region") includes a dielectric having a different thickness or a different relative permittivity from the dielectric 127 constituting the second region 122*c*.

In this case, for example, the second region 122*c* receives the side lobe of the first radio wave, the main lobe of the second radio wave, and the main lobe of the third radio wave, and the dielectric 127 constituting the second region 122*c* increases the phase of the first radio wave by an odd multiple of 180 degrees with respect to the phase of the first radio wave reflected by the second region 122*c* in a case where the second region 122*c* does not have the dielectric 127, and increases the phases of the second radio wave and the third radio wave by an even multiple of 180 degrees with respect to the phases of the second radio wave and the third radio wave reflected by the second region 122*c* in a case where the second region 122*c* does not have the dielectric 127. In addition, the third region receives the side lobe of the first radio wave, the main lobe of the second radio wave, and the side lobe of the third radio wave, and the dielectric included in the third region increases the phases of the first radio wave and the third radio wave by an odd multiple of 180 degrees with respect to the phases of the first radio wave and the third radio wave reflected by the second region 122*c* in a case where the second region 122*c* does not have the dielectric 127, and increases the phase of the second radio wave by an even multiple of 180 degrees with respect to the phase of the second radio wave reflected by the second region 122*c* in a case where the second region 122*c* does not have the dielectric 127.

As described above, the reflector antenna device 122*c* includes the primary radiator 110 to radiate the first radio wave that is the radio wave in the first frequency band and radiate the second radio wave that is the radio wave in the second frequency band lower in frequency than the first frequency band, and the reflector having the reflection face that receives the first radio wave and the second radio wave radiated by the primary radiator 110 and reflects the first radio wave and the second radio wave, and is configured so that the reflection face included in the reflector includes the first region 121 including the center point of the reflection face and the second region 122*c* that is the outer peripheral region of the first region 121 and is the region including the conductor 126 and the dielectric 127 provided on the conductor 126, the dielectric 127 constituting the second region 122*c* of the reflection face included in the reflector receives the first radio wave and the second radio wave radiated by the primary radiator 110 and transmits the first radio wave and the second radio wave, the conductor 126 constituting the second region 122*c* of the reflection face included in the reflector reflects the first radio wave and the second radio wave transmitted through the dielectric 127, the second region 122*c* of the reflection face included in the reflector reflects the first radio wave and the second radio wave reflected by the conductor 126 by transmitting the first radio wave and the second radio wave reflected by the conductor 126 through the dielectric 127 again and radiating the first radio wave and the second radio wave, and the dielectric 127 constituting the second region 122*c* of the reflection face included in the reflector increases the phase of the first radio wave reflected by the second region 122*c* by an odd multiple of 180 degrees with respect to the phase of the first radio wave reflected by the second region 122*c* in a case where the second region 122*c* does not have the dielectric 127, and increases the phase of the second radio wave reflected by the second region 122*c* by an even multiple of 180 degrees with respect to the phase of the second radio wave reflected by the second region 122*c* in a case where the second region 122*c* does not have the dielectric 127.

With this configuration, the reflector antenna device 100*c* can suppress the spillover of the side lobe of the radio wave in the high frequency band while suppressing the decrease in the gain of the secondary radiation pattern of the radio wave in the high frequency band.

Furthermore, with such a configuration, the reflector antenna device 100*c* can improve the gain of the secondary radiation pattern of the radio wave in the high frequency band output from the reflector antenna device 100*c* by suppressing the spillover of the side lobe of the radio wave in the high frequency band.

Furthermore, as described above, in the above-described configuration, the reflector antenna device 100*c* is configured so that the reflection face included in the first reflector 120*c* that is a reflector is a quadratic face or a parabolic face.

With this configuration, the reflector antenna device 100*c* can suppress the spillover of the side lobe of the radio wave in the high frequency band while suppressing the decrease in the gain of the secondary radiation pattern of the radio wave in the high frequency band.

Furthermore, with such a configuration, the reflector antenna device 100*c* can improve the gain of the secondary radiation pattern of the radio wave in the high frequency band output from the reflector antenna device 100*c* by suppressing the spillover of the side lobe of the radio wave in the high frequency band.

Furthermore, as described above, in the above-described configuration, the reflector antenna device 100*c* is configured so that the second region 122*c* of the reflection face included in the first reflector 120*c* that is a reflector is a region that receives the side lobe of the first radio wave radiated by the primary radiator 110 and the main lobe of the second radio wave radiated by the primary radiator 110.

With this configuration, the reflector antenna device 100*c* can suppress the spillover of the side lobe of the radio wave in the high frequency band while suppressing the decrease in the gain of the secondary radiation pattern of the radio wave in the high frequency band.

Furthermore, with such a configuration, the reflector antenna device 100*c* can improve the gain of the secondary radiation pattern of the radio wave in the high frequency band output from the reflector antenna device 100*c* by suppressing the spillover of the side lobe of the radio wave in the high frequency band.

It should be noted that the invention of the present application can freely combine the embodiments, modify any constituent element of each embodiment, or omit any constituent element in each embodiment within the scope of the invention.

INDUSTRIAL APPLICABILITY

The present invention is suitable for a reflector antenna device including a primary radiator and a reflector.

REFERENCE SIGNS LIST

100, 100*a*, 100*b*, 100*c*: Reflector antenna device, 110, 110*b*: Primary radiator, 120, 120*a*, 120*b*, 120*c*: First reflector, 121: First region. 122, 122*b*1, 122*c*: Second region, 122*b*2: Third region, 123, 123*b*1, 123*b*2: Recess, 124, 124*b*1, 124*b*2: Opening, 125, 125*b*1, 125*b*2: Bottom face, 126: Conductor, 127: Dielectric, 130: Second reflector

What is claimed is:

1. A reflector antenna device, comprising:

a primary radiator to radiate a first radio wave that is a radio wave in a first frequency band and radiate a second radio wave that is a radio wave in a second frequency band lower in frequency than the first frequency band; and a reflector having a reflection face that receives the first radio wave and the second radio wave radiated by the primary radiator and reflects the first radio wave and the second radio wave, wherein the reflection face included in the reflector has a first region including a center point of the reflection face and a second region that is an outer peripheral region of the first region and is a region provided with a plurality of recesses, and each of the plurality of recesses provided in the second region of the reflection face included in the reflector allows the first radio wave to enter the recess, restricts the second radio wave from entering the recess, and reflects the first radio wave that has entered the recess on a bottom face of the recess.

2. The reflector antenna device according to claim 1, wherein a maximum value "L" of a length of each of the plurality of recesses provided in the second region of the reflection face included in the reflector in a plane parallel to the reflection face falls within a range defined by the following formula (1), $$\frac{C_x}{\pi F_H} < L < \frac{C_x}{\pi F_L} \tag{1}$$

where "C" is the speed of light, "χ" is a positive minimum root in a first derivative of the Bessel function of the first kind, "π" is a circular constant, "FH" is the first frequency band, and "FL" is the second frequency band.

3. The reflector antenna device according to claim 1, wherein each of the plurality of recesses provided in the second region of the reflection face included in the reflector causes a phase of the first radio wave having entered the recess and reflected on the bottom face of the recess to be a same phase as a phase of the first radio wave reflected by the first region of the reflection face included in the reflector at an opening of the recess.

4. The reflector antenna device according to claim 1, wherein a depth of each of the plurality of recesses provided in the second region of the reflection face included in the reflector is an odd multiple of a ¼ wavelength of the first radio wave.

5. A reflector antenna device, comprising:

a primary radiator to radiate a first radio wave that is a radio wave in a first frequency band and radiate a second radio wave that is a radio wave in a second frequency band lower in frequency than the first frequency band; and a reflector having a reflection face that receives the first radio wave and the second radio wave radiated by the primary radiator and reflects the first radio wave and the second radio wave, wherein the reflection face included in the reflector includes a first region including a center point of the reflection face, and a second region that is an outer peripheral region of the first region and is a region including a conductor and a dielectric provided on the conductor, the dielectric constituting the second region of the reflection face included in the reflector receives the first radio wave and the second radio wave radiated by the primary radiator and transmits the first radio wave and the second radio wave, the conductor constituting the second region of the reflection face included in the reflector reflects the first radio wave and the second radio wave transmitted through the dielectric, the second region of the reflection face included in the reflector reflects the first radio wave and the second radio wave radiated from the primary radiator by transmitting the first radio wave and the second radio wave reflected by the conductor through the dielectric again and radiating the first radio wave and the second radio wave, and the dielectric constituting the second region of the reflection face included in the reflector increases a phase of the first radio wave reflected by the second region by an odd multiple of 180 degrees with respect to a phase of the first radio wave reflected by the second region in a case where the second region does not include the dielectric, and increases a phase of the second radio wave reflected by the second region by an even multiple of 180 degrees with respect to a phase of the second radio wave reflected by the second region in a case where the second region does not include the dielectric.

6. The reflector antenna device according to claim 1, wherein the reflection face included in the reflector is a quadratic face.

7. The reflector antenna device according to claim 2, wherein the reflection face included in the reflector is a quadratic face.

8. The reflector antenna device according to claim 3, wherein the reflection face included in the reflector is a quadratic face.

9. The reflector antenna device according to claim 4, wherein the reflection face included in the reflector is a quadratic face.

10. The reflector antenna device according to claim 5, wherein the reflection face included in the reflector is a quadratic face.

11. The reflector antenna device according to claim 1, wherein the reflection face included in the reflector is a parabolic face.

12. The reflector antenna device according to claim 2, wherein the reflection face included in the reflector is a parabolic face.

13. The reflector antenna device according to claim 3, wherein the reflection face included in the reflector is a parabolic face.

14. The reflector antenna device according to claim 4, wherein the reflection face included in the reflector is a parabolic face.

15. The reflector antenna device according to claim 5, wherein the reflection face included in the reflector is a parabolic face.

16. The reflector antenna device according to claim 1, wherein the second region of the reflection face included in the reflector is a region that receives a side lobe of the first radio wave radiated by the primary radiator and a main lobe of the second radio wave radiated by the primary radiator.

17. The reflector antenna device according to claim 2, wherein the second region of the reflection face included in the reflector is a region that receives a side lobe of the first radio wave radiated by the primary radiator and a main lobe of the second radio wave radiated by the primary radiator.

18. The reflector antenna device according to claim 3, wherein the second region of the reflection face included in the reflector is a region that receives a side lobe of the first radio wave radiated by the primary radiator and a main lobe of the second radio wave radiated by the primary radiator.

19. The reflector antenna device according to claim 4, wherein the second region of the reflection face included in the reflector is a region that receives a side lobe of the first radio wave radiated by the primary radiator and a main lobe of the second radio wave radiated by the primary radiator.

20. The reflector antenna device according to claim 5, wherein the second region of the reflection face included in the reflector is a region that receives a side lobe of the first radio wave radiated by the primary radiator and a main lobe of the second radio wave radiated by the primary radiator.

* * * * *